US006285297B1

(12) United States Patent
Ball

(10) Patent No.: US 6,285,297 B1
(45) Date of Patent: Sep. 4, 2001

(54) DETERMINING THE AVAILABILITY OF PARKING SPACES

(76) Inventor: Jay H. Ball, 11 Russell Cir., Natick, MA (US) 01760

( * ) Notice: Subject to any disclaimer, the term of this patent is extended or adjusted under 35 U.S.C. 154(b) by 0 days.

(21) Appl. No.: 09/304,277

(22) Filed: May 3, 1999

(51) Int. Cl.[7] ..... B06Q 1/48

(52) U.S. Cl. ..... 340/932.2; 340/994; 340/995; 348/143; 348/152

(58) Field of Search ..... 340/932.2, 994, 340/995; 348/143, 152

(56) References Cited

U.S. PATENT DOCUMENTS

| | | | | |
|---|---|---|---|---|
| 3,110,010 | | 11/1963 | Smith | 340/51 |
| 3,158,836 | | 11/1964 | McCauley | 340/51 |
| 3,376,547 | | 4/1968 | Auer, Jr. | 340/51 |
| 4,812,843 | | 3/1989 | Champion, III et al. | 340/905 |
| 4,847,772 | | 7/1989 | Michalopoulos et al. | 364/436 |
| 5,091,727 | | 2/1992 | Mahmood et al. | 340/932.2 |
| 5,103,400 | | 4/1992 | Yamada et al. | 364/444 |
| 5,131,020 | | 7/1992 | Liebesny et al. | 379/59 |
| 5,163,000 | | 11/1992 | Rogers et al. | 364/424.01 |
| 5,199,108 | | 3/1993 | Morgan et al. | 455/18 |
| 5,241,380 | * | 8/1993 | Benson et al. | 358/108 |
| 5,343,237 | * | 8/1994 | Morimoto | 348/143 |
| 5,396,429 | | 3/1995 | Hanchett | 364/436 |
| 5,432,508 | | 7/1995 | Jackson | 340/932.2 |
| 5,504,314 | | 4/1996 | Farmont | 235/384 |
| 5,509,082 | | 4/1996 | Toyama et al. | 382/104 |
| 5,526,041 | * | 6/1996 | Glatt | 348/143 |
| 5,649,300 | | 7/1997 | Snyder et al. | 455/517 |
| 5,666,157 | * | 9/1997 | Aviv | 348/152 |
| 5,748,107 | | 5/1998 | Kersken et al. | 340/905 |
| 5,751,973 | | 5/1998 | Hassett | 395/213 |
| 5,777,951 | * | 7/1998 | Mitschele | 368/90 |
| 5,910,782 | * | 6/1999 | Schmitt et al. | 340/995 |
| 5,940,481 | * | 8/1999 | Zeitman | 379/114 |

* cited by examiner

*Primary Examiner*—Daniel J. Wu
*Assistant Examiner*—Tai T. Nguyen
(74) *Attorney, Agent, or Firm*—Fish & Richardson, P.C.

(57) ABSTRACT

The invention provides a system for determining and communication the availability of parking spaces. The system includes an optical adapted to scan a plurality of the parking spaces and to produce scan data for the parking spaces scanned. The system also includes a processor adapted to receive the scan data from the optical detector and to determine the availability of the scanned parking spaces from the scan data. The system may include a telephone link and/or a radio transmitter for transmitting a signal to indicate the parking pace availability.

19 Claims, 6 Drawing Sheets

DETERMINING THE AVAILABILITY OF PARKING SPACES

BACKGROUND OF THE INVENTION

This invention relates generally to managing parking spaces, and more particularly, to determining and broadcasting the availability of vehicle parking spaces.

Motorists often become frustrated while searching for an available parking space. The frustration increases as the searching continues, because random searching does not assure the motorist an on-street or facility parking space within a fixed amount of time. Systems to determine and communicate the availability of parking spaces could lead to more efficient use of existing parking facilities in crowded city centers.

The prior art includes some systems for detecting available parking spaces. These systems rely on separate sensing apparatus positioned at each parking space. One system places a separate transmitter-receiver pair at each parking space. The presence of a vehicle at the space is detected by a partial interruption or reflection of the transmitted signal. Such transmitter-receiver pairs can be unreliable in various weather conditions. For example, snow, mud, or water may cover or partially occlude ground-level transmitters thereby causing the presence or absence of a vehicle to be misinterpreted. Devices located at individual parking spaces can also be physically damaged. For example, vehicle traffic into and out of the spaces can damage components located at ground-level. Placing a detection device at each parking space may also be prohibitively expensive, especially when the cost of wiring or other systems for communicating to a central location is included.

Other systems inform motorists of the availability of parking in a facility, e.g., a parking garage, by hanging a "FULL" or "NOT FULL" sign at the entrance, but the motorist may still waste time coming to a full facility. Also, such signs may not accurately reflect the status of the facility after time has elapsed.

The present invention is directed to overcoming, or at least reducing, one or more of the problems set forth above.

SUMMARY OF THE INVENTION

In one aspect, the invention provides a system for determining the availability of parking spaces. The system includes an optical detector adapted to scan a plurality of parking spaces and to produce scan data for the parking spaces scanned. The system also includes a processor adapted to receive the scan data from the optical detector and to determine the availability of the scanned spaces from the scan data.

In some preferred embodiments, the optical detector includes a video camera positioned to provide scan data for a plurality of the parking spaces without moving.

In other preferred embodiments, the optical detector includes a video camera and an electromechanical device. The electromechanical device mechanically couples to the video camera and is capable of changing the orientation of the video camera to produce the scan data for the plurality of parking spaces or for several plurality of parking spaces.

In another aspect, the invention provides a method for determining the availability of parking spaces. The method includes viewing a plurality of the parking spaces with a video camera and processing one or more images from the viewing to determine which if any of the parking spaces are available. The method also includes updating a list reflecting the availability in response to processing the or more images and transmitting a signal indicating the availability of a portion of the plurality of parking spaces.

BRIEF DESCRIPTION OF THE DRAWINGS

Other objects, features, and advantages of the invention will be apparent from the following description, taken together with the drawings in which.

DESCRIPTION OF THE PREFERRED EMBODIMENTS

Figure 1:
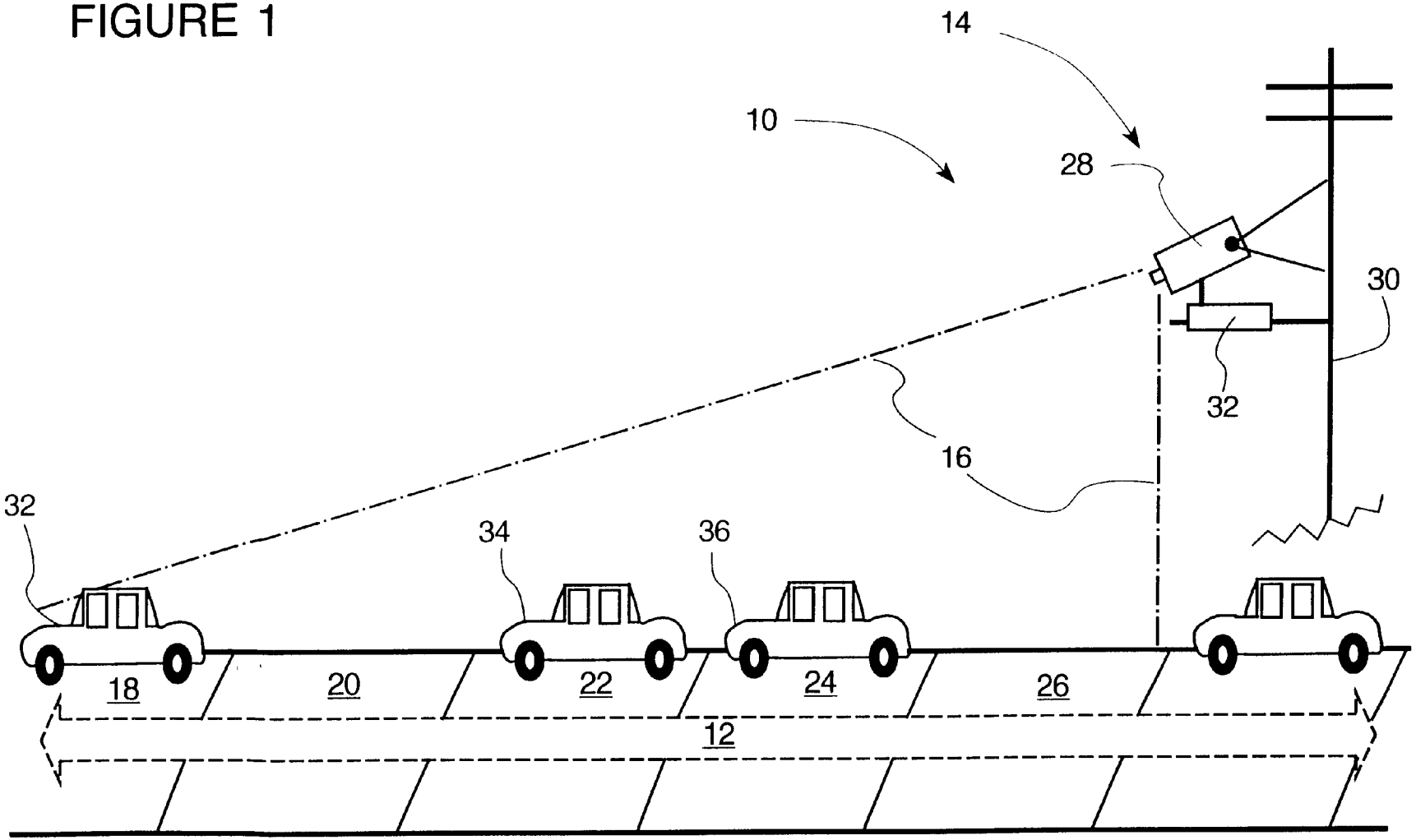
FIG. 1 illustrates one embodiment of a sensing system for the availability of on-street parking spaces.

FIG. 1 illustrates a sensing system 10 for detecting the available parking spaces along one or both sides of a street 12. An optical detector 14 is capable of scanning an image field 16. The image field 16 includes a plurality of parking spaces 18, 20, 22, 24, 26 along the side of a straight or curved section of the street 12. The optical detector 14 can visually scan the parking spaces 18, 20, 22, 24, 26 either by pivoting or without pivoting.

Still referring to FIG. 1, the optical detector 14 of some embodiments employs a video camera 28 pivotally connected to a rigid support 30. The support 30 may be any elevated and immovable structure, such as a utility pole, a rooftop, or a building side, which provides a view of the parking spaces 18, 20, 22, 24, 26 located therebelow. An electromechanical device 32, e.g., a motor, mechanically pivots the aim of the video camera 28 to provide several different scans of the image field 16. Pivoting the camera 28 moves the field of view to provide images of additional areas.

Still referring to FIG. 1, the optical detector 14 can image a plurality of the parking spaces 18, 20, 22, 24, 26 simultaneously by using the detector's 14 wide field of view. For example, some embodiments employ a video camera 28 with a wide angle lens or a split mirror (both not shown), and other embodiments employ a pair of video cameras. For example, the wide angle lens enables the camera 28 to obtain data for determining whether any of the spaces 18, 20, 22, 24, 26 are occupied from a single video image.

Still referring to FIG. 1, analysis of data signals generated by the optical detector 14 determines whether the vehicles 32, 34, 36 occupy the on-street parking spaces 18, 20, 22, 24, 26. In some embodiments, the electromechanical device 32 augments the video data with orientation data to directly communicate the orientation of the video camera 28 along with each video image of a scan. Other embodiments simultaneously image the parking spaces 18–26 to generate the scan data for determining the occupancy of each space 18–26 from different portions of a single image. In the various embodiments, further processing of the video images determines which of the parking spaces 18, 20, 22, 24, 26 is occupied.

Figure 2:
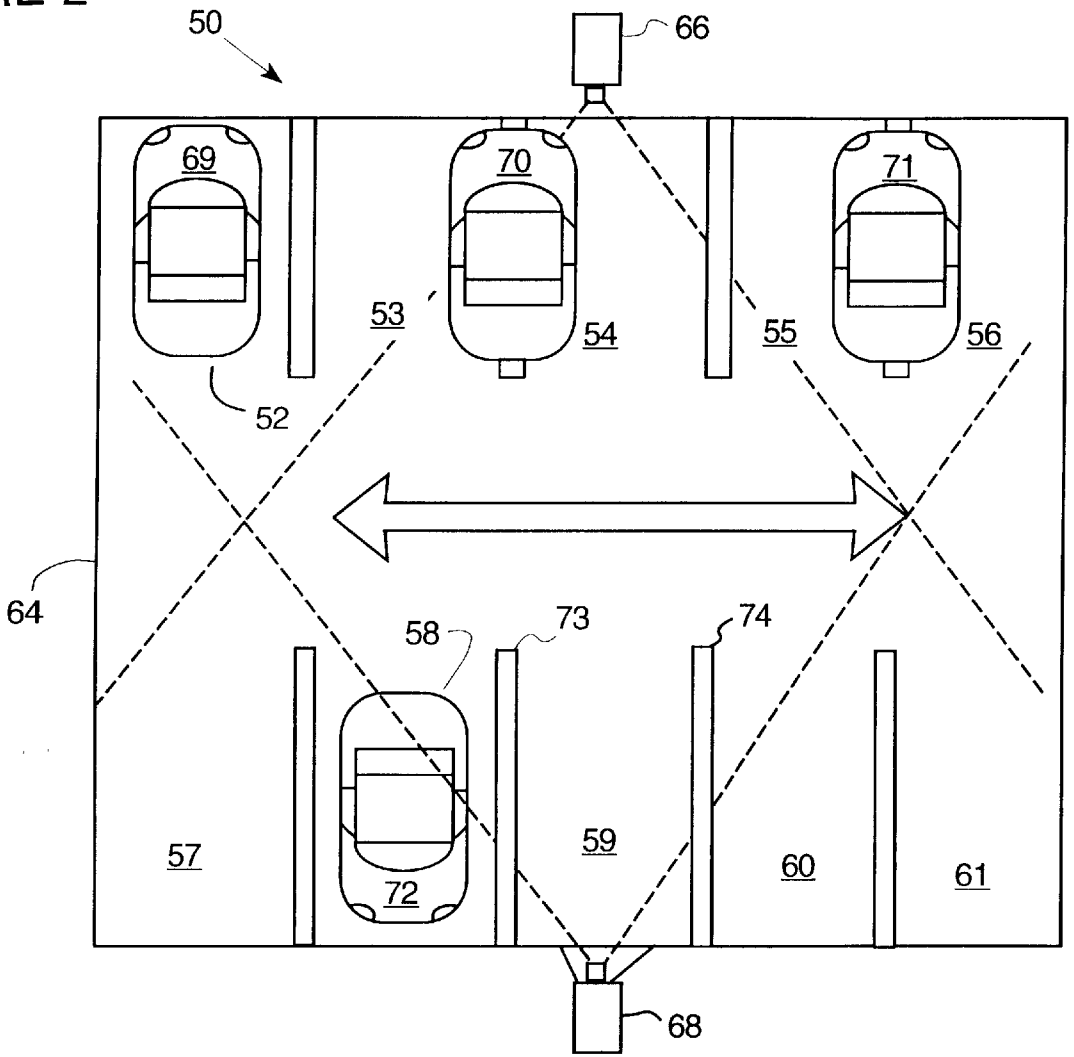
FIG. 2 illustrates one embodiment of a sensing system for the availability of parking spaces in a parking lot or garage.

FIG. 2 illustrates a sensing system 50 for detecting the available and occupied parking spaces 52–61 in a portion 64 of an off-street parking garage or parking lot. The sensing system 50 includes first and second video cameras 66, 68 mounted to elevated fixtures (not shown). The first and second video cameras 66, 68 visually scan respective first and second portions of the parking area 64, i.e. the first spaces 57–61 and the second spaces 52–56. Analysis of the visual scan images can determine the occupation of the spaces 52, 53, 54, 55, 56, 58 by vehicles 69–72.

Referring to FIG. 2, some embodiments employ electromechanical devices (not shown), e.g., the device 32 of FIG. 1, to perform angular scans of the parking spaces 52–61 with the video cameras 66, 68. In such embodiments, the video cameras 66, 68 pivotally mount to the elevated fixtures (not shown) and pivot during scans. The electromechanical devices may also generate orientation data for matching video images with individual parking spaces, or the scans may be timed and follow fixed paths to obviate the need for orientation data.

Still referring to FIG. 2, other embodiments of the video cameras 66, 68 can image a plurality of the parking spaces 52–61 simultaneously due to camera's 66, 68 wide field of view. In one such embodiment, the video cameras 66, 68 have wide angle lenses (not shown). The wide angle lenses enable the cameras 66, 68 to obtain video data for determining whether any of the spaces 52–61 are occupied from two video images.

Still referring to FIG. 2, the various embodiments employ different methods for identifying the different spaces 52–61 and vehicles 69–72 therein. Analyzing single video images or portions of single images with image recognition software can produce a list of or the number of available parking spaces 52–61.

Referring to FIGS. 1 and 2, the image data from the systems 10, 50, are more adapted to determining space availability than beam interruption or reflection data from prior art transmitter-receiver pairs. Interruption or reflection data for light sources located at each parking space is susceptible to false interruptions due to conditions such as snowfall, rainfall, mud, and dirt build up. The interpretation of video images from the abovedescribed embodiments by well-known machine-vision software is less susceptible to such errors. The systems 10, 50, are also less susceptible to damage from vehicle traffic, because the optical detectors 14, 66, 68, are located above the region in which vehicles circulate. The optical detectors 14, 66, 68, are less susceptible to weather-related inaccuracies and vehicle-caused damage than separate detectors located at individual parking spaces.

Referring to FIGS. 1 and 2, some embodiments of the systems 10, 50 also account for vehicle misparking when determining the availability of parking spaces. For example, vehicles 70, 71 are parked on a substantial portion of each space 53–56 of a parking row in FIG. 2. Nevertheless, misparking has left an empty space between the vehicles 70, 71, which is large enough for another vehicle (not shown). Analyzing two video images for the adjacent spaces 54, 55 or a single image in which the camera 68 aims between the adjacent spaces 54, 55 could detect the space left therebetween by misparking. A prior art system using a separate sensor for each parking space 52–56 could not detect such spaces, because the available space is between the delineated spaces 54, 55. The scanning systems 10, 50 may also determine the availability of parking where parking spaces are not delineated by lines or at fixed positions, e.g., in random on-street parking.

Referring again to FIGS. 1 and 2, the various sensing systems 10, 50, may produce monoscopic or stereoscopic visual images of the parking spaces being observed. For example, both paired cameras and split-mirrors (both not shown) can produce stereoscopic visual scanning images. Stereoscopic images may provide additional data enabling more reliable analysis of the presence of vehicles.

Figure 3:
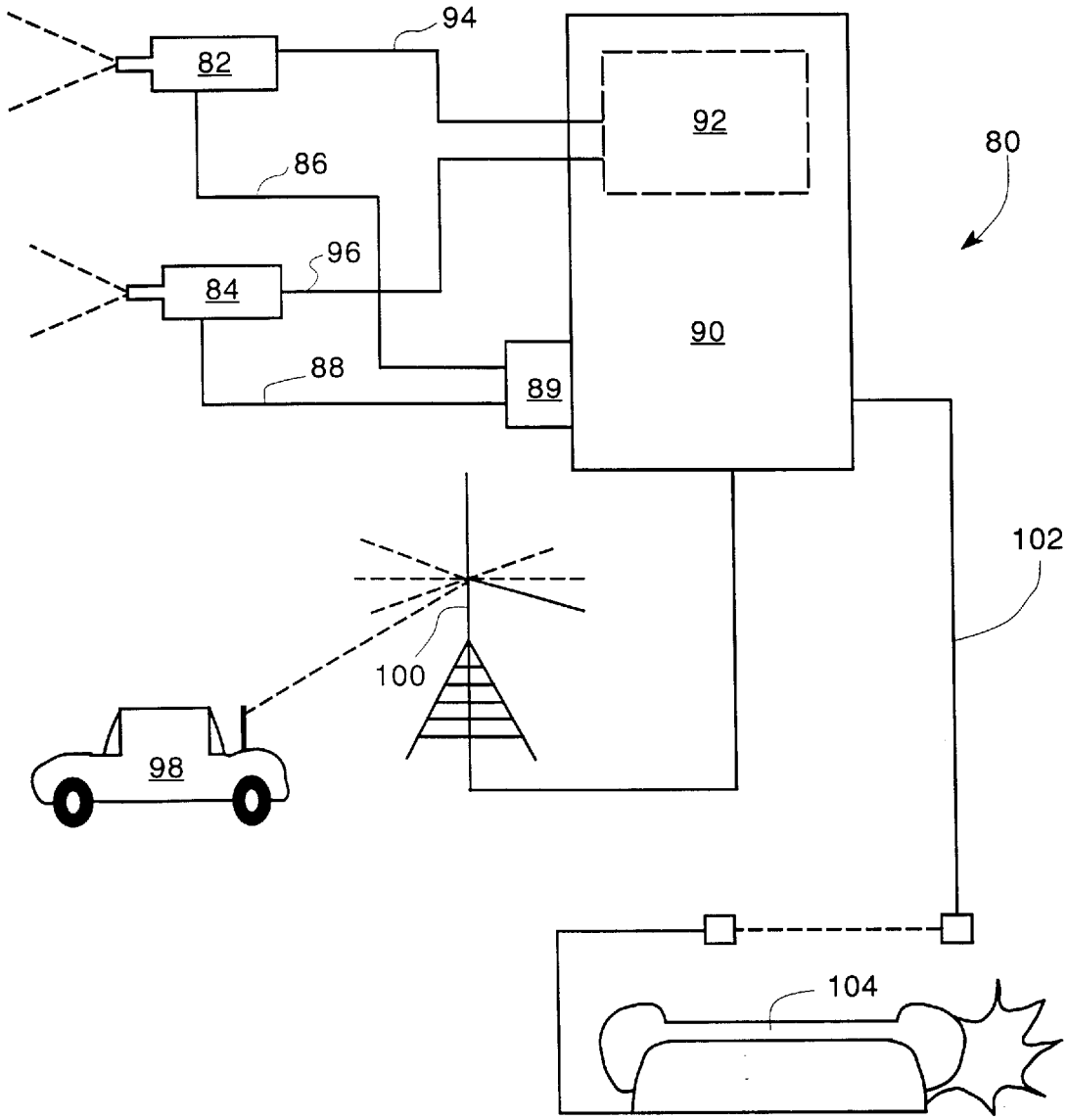
FIG. 3 illustrates one embodiment of a system for sensing and transmitting parking space availability.

FIG. 3 illustrates a central processing system 80 for analyzing optical scanning data and providing a motorist with data on the availability of parking spaces. The system 80 includes a plurality of optical detectors 82, 84 that provide visual scan data on parking spaces, e.g., detectors 14, 66, 68, of FIGS. 1 and 2. The optical detectors 82, 84 may observe parking spaces at separated facilities. For example, the first and second detectors 82, 84 may correspond to the on-street detector 14 of FIG. 1 and the parking garage detector 66 of FIG. 2. Data cables or radio or infrared links 86, 88 transmit the visual data from the optical detectors 82, 84 to an image grabber 89 for the visual data. An image processor 90 receives the images of visual data from the image grabber 89, e.g., the image grabber 89 may be a digital data interface. The image processor 90 may be programmed to perform machine-vision and image recognition algorithms, known to persons skilled in the art, for recognizing objects and/or vehicles. The image processor 90 analyzes images or portions of the images of the visual scan data sequentially, e.g., to determine whether the individual parking spaces, e.g., the spaces 18–26 and 57–61, are empty or occupied.

Still referring to FIG. 3, a portion 92 of the processor 90 may generate scan control signals. Cables 94, 96 connect the portion 92 of the processor 90 to the optical detectors 82, 84. In some embodiments, the cables 86, 88 also carry scan orientation data from the optical detectors 82, 84 to the processor 90. For example, the orientation data may be generated by the electromechanical device 32 of FIG. 1. Then, the orientation data provides feedback that the portion 92 of the processor 90 uses to direct the control of the scans or to selectively scan portions of the parking spaces.

Still referring to FIG. 3, some embodiments program the processor 90 with image recognition algorithms adapted to identify different parking spaces on a single image. These algorithms are known to those skilled in the art and can correlate portions of a single image to separate parking spaces. Programming such an algorithm into the processor 90 enables using a single wide-view scan image to determine the occupancy of several parking spaces.

Still referring to FIG. 3, various media can transmit the image data from the optical detectors 82, 84 and/or control signals from the portion 92 of the processor 90 in the various embodiments. In one embodiment, the image data and/or scan control signals pass via the cables 94, 96 and 86, 88. In other embodiments, the cables 86, 88, 94, 96 are absent and radio or infrared data links couple the optical detectors 82, 84 to the processor 90. The present invention covers all equivalent methods for transmitting signals between the processor 90 and optical detectors 82, 84, which would be known to a person of skill in the art in light of the present disclosure.

Still referring to FIG. 3, the image processor 90, provides motorists 98 with information on the availability of parking spaces. Means for broadcasting the information include a radio broadcasting system 100 and a telephone link 102.

In some embodiments, the system 80 of FIG. 3 uses a radio broadcasting system 100 to transmit space availability data to motorists 98. The radio broadcast system 100 transmits an availability data report produced by the processor 90 in the form of an audio broadcast bulletin. The bulletin may be an up-to-the-minute advisory of the locations of parking facilities and/or streets with available spaces and the number of spaces available therein. The motorist 98 receives the broadcast bulletin by tuning his/her car radio (not shown) to the broadcast frequency of the radio system 100. The radio broadcasting system 100 may use a low-power AM or FM transmitter with an antenna near the center of a local area where the transmission is to be received. In some embodiments, area signs (not shown) would inform the motorist 98 that a local transmission of the broadcast bulletin is available at an announced AM or FM frequency. The processor 90 regularly updates the availability data so that the broadcast bulletin provides up-to-date space availability at several "area" parking facilities and/or streets.

Still referring to FIG. 3, some embodiments include a telephone link 102 to the image processor 90. A motorist can use a telephone 104, e.g., a portable cellular telephone, to call up the link 102 and obtain information on available parking spaces even from outside of the broadcast range of the radio system 100. In response to a telephone call, the image processor 90 may automatically send an audio message with a list of the numbers and locations of available parking spaces, to the telephone link 102.

Still referring to FIG. 3, the image processor 90 may prompt the motorist by the telephone link 102 so that a motorist can select the area or parking facilities where he wants to park. Then, the processor 90 would provide an audio message tailored to the motorist's voice or tone selection. The audio message would list parking availability near a location, major landmark, street or off-street facility selected by the motorist. The audio message could rank the available parking locations by closeness, i.e. nearest, next nearest, etc., to a location or major landmark selected by the motorist. The processor 90 may have voice recognition software to enable the motorist to orally relate selections via the telephone 104. The processor 90 may also accept digital tones from the motorist's telephone keypad.

Figure 4:
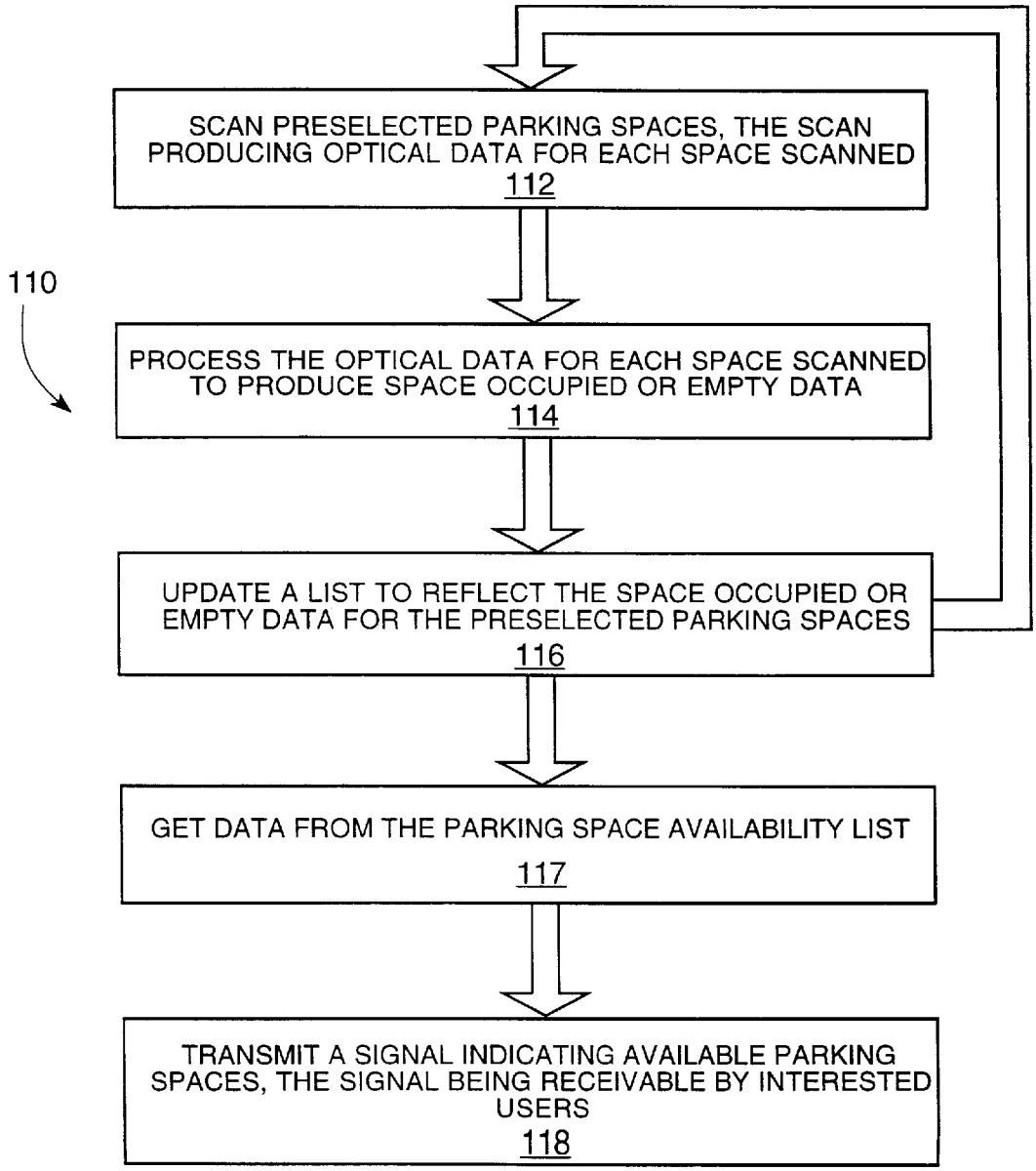
FIG. 4 is a flow chart illustrating a method of operating the sensing and transmitting system of FIG. 3.

FIG. 4 illustrates a method 110 for determining the availability of parking spaces with the system 80 of FIG. 3. At block 112, one or more of the optical detectors 82, 84 scans or views preselected parking spaces. The scan produces optical data for the occupancy of each parking space or multiplicity of spaces scanned. At block 114, the image processor 90 processes the optical data to produce space occupied and/or space empty data. Some embodiments process a separate image to find the availability of each parking space. Other embodiments process a separate portion of a single image to find availability of each parking space. At block 116, the processor 90 updates a "parking space availability" file or list to reflect only the most recent occupied/empty data for each of the preselected parking spaces scanned. After completing the update of block 116, the system 80 returns to block 112 to get new scan data.

In the various embodiments, the processor 90 uses the parking space availability file to asynchronously produce parking space availability signals, which are detectable by motorists. At block 117, the processor 90 gets data from the parking space availability file or list. At block 118, the image processor 90 transmits an audio signal indicating parking space availabilities and locations. The signal may be transmitted as a continuous broadcast of the complete "parking availability file" over the radio system 110. The signal may also be transmitted as all or a selected portion of the "parking availability file" over the telephone link 102 in response to a prompt or inquiry by a motorist.

Figure 5:
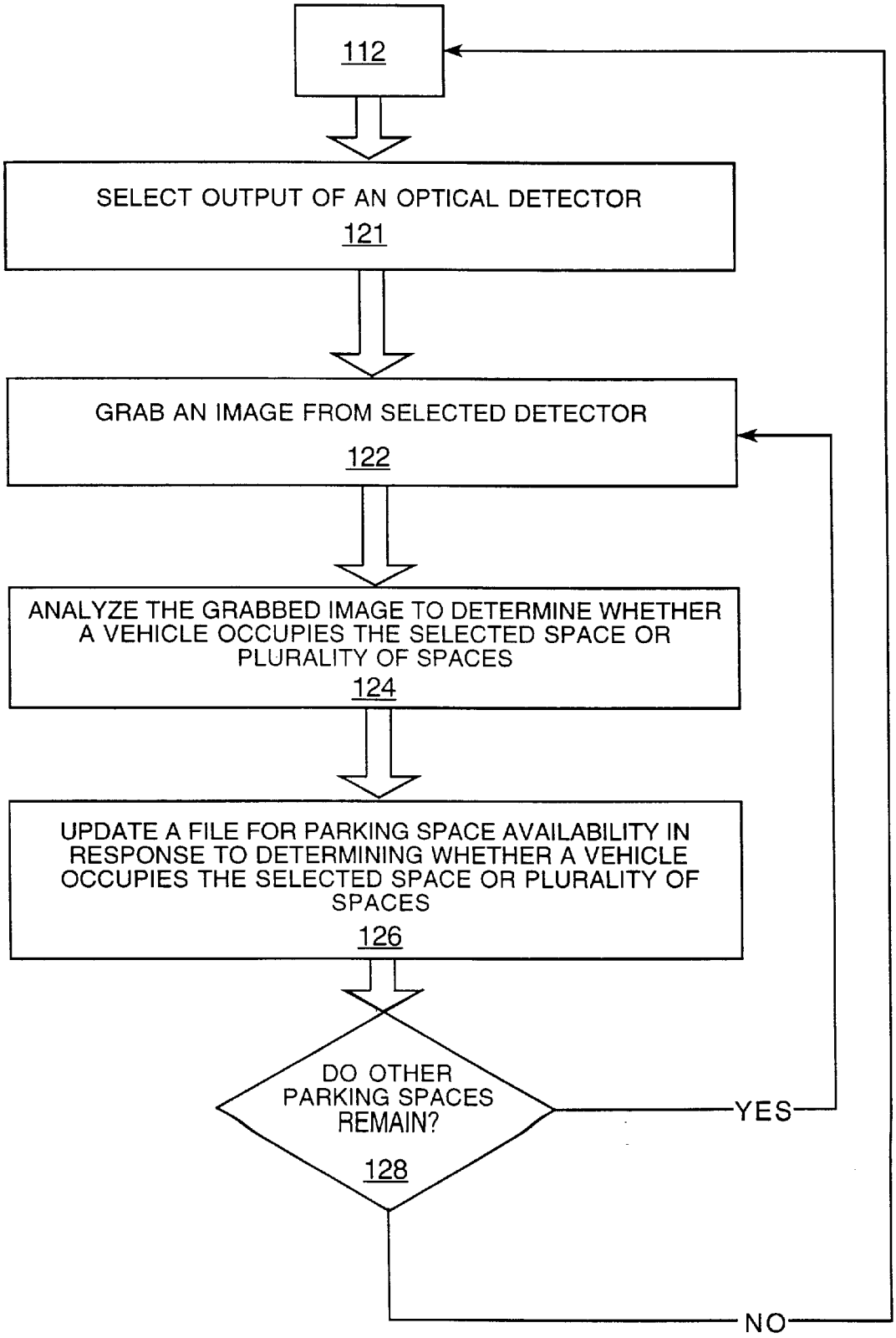
FIG. 5 is a flow chart illustrating a method of processing the view data and updating the availability of parking spaces in FIG. 4.

FIG. 5 is a flow chart illustrating an embodiment for processing the scan data and updating the space availability in blocks 114 and 116 of FIG. 4. At block 121, the processor 90 selects the output of one of the detectors 82, 84. At block 122, the image processor 90 grabs or freezes an image of the selected output. At block 124, the processor 90 analyzes the grabbed image to determine whether one or more vehicles occupy the selected parking space or plurality of parking spaces. The analysis may employ any of a variety of object or image recognition algorithms known to those of skill in the art. In embodiments viewing several spaces on the one image, the step of analyzing may include choosing a portion of the image corresponding to the selected parking space. At block 126, the processor 90 updates a file for parking space availability in response to determining whether one or more vehicle occupy the selected space or plurality of spaces. At block 128, the processor 90 selects the next parking space or plurality of spaces for which the availability remains to be determined. The processor 90 cycles to block 122 to sequentially grab an image of the next parking space or plurality of parking spaces. In response to running through all the spaces, the processor 90 returns to block 112 to check for the occupancy of the first space or first plurality of spaces.

Still referring to FIG. 5, the processor 90 of some embodiments continually cycles through all of the parking spaces to provide a continually updated parking availability file. In other embodiments, the processor 90 cycles through the parking spaces and updates the space availability file at predetermined intervals, e.g., at five minute or ½ hour intervals.

Figure 6:
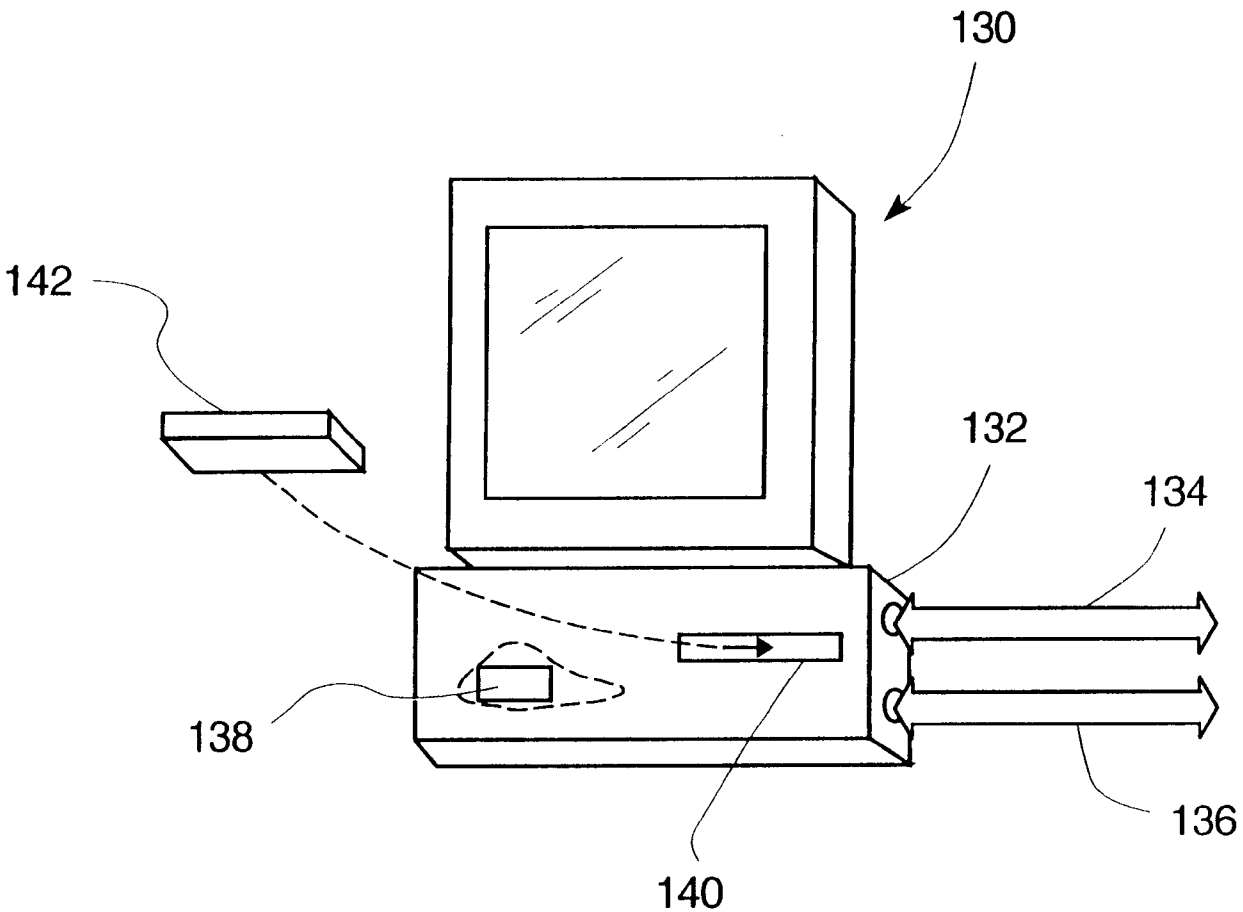
FIG. 6 shows one embodiment of the image processor of FIG. 3.

FIG. 6 illustrates one embodiment 130 of the image processor 90 of FIG. 3. A computer 132 has an input/output (I/O) interface 134 coupling to the cables 86, 88, 94, 96 from and to the optical detectors 82, 84. The computer 132 also has a second I/O interface 136 for coupling to the radio broadcasting system 100 and/or the telephone link 102. The computer 132 has an internal memory 138, i.e., an active program storage device, to store programs for implementing the steps of the methods 110, 120 of FIGS. 4 and 5. A drive 140 enables the computer 132 to read a program storage device 142 such as an optical disk, a magnetic disk, or a magnetic tape. The program storage device 142 encodes one or more programs of instructions executable on the computer 132 to perform a method for determining the availability of parking spaces, e.g., the methods 110, 120 of FIGS. 4 and 5.

What is claimed is:

1. A system for determining the availability of parking spaces including on-street parking spaces, comprising:

a non-stereoscopic optical detector adapted to scan a plurality of the on-street parking spaces and to produce scan data for the on-street parking spaces scanned;

a processor adapted to receive the scan data from the optical detector and to determine the availability of the on-street parking spaces scanned from the scan data; and a device adapted to receive parking space availability data from the processor, the device adapted to broadcast information on available ones of the parking spaces to interested persons via AM or FM transmission or to wireless telephone devices.

2. The system of claim 1, further comprising a radio transmitter coupled to an output interface of the processor, the processor capable of producing an audio signal comprising information on availability of the parking spaces, the transmitter capable of transmitting the audio signal on frequencies receivable by motorist radios.

3. The system of claim 1, wherein the optical detector comprises:

a video camera to produce the scan data, the scan data being one or more video images, each video image being of a portion of the plurality of parking spaces.

4. The system of claim 3, further comprising:

an electromechanical device being mechanically coupled to the video camera and capable of changing an orientation of the video camera's field of view to scan different portions of the plurality of parking spaces.

5. The system of claim 4, wherein the processor is capable of transmitting control signals; and wherein the electromechanical device is adapted to receive the control signals and to change the orientation of the video camera in response to receiving said control signals.

6. The system of claim 3, wherein the first and second pluralities of the parking spaces are located on a street and in off-street facilities, respectively.

7. The system of claim 1, further comprising:

a second optical detector adapted to scan a second plurality of the parking spaces and to produce scan data for the second plurality of parking spaces; and wherein the processor is adapted to receive the scan data from the second optical detector and to determine which of the second plurality of the parking spaces are occupied from the scan data for the second plurality of the parking spaces.

8. The system of claim 7, wherein the first and second optical detectors are adapted to produce at least one video image for each multiplicity of parking spaces scanned.

9. The system of claim 1, further comprising a telephone link coupled to a input/output interface of the processor, the processor capable of producing an audio signal on the telephone link in response to a telephone call thereto, the audio signal comprising information on availability of the parking spaces.

10. The system of claim 9, wherein the processor is adapted to send prompts for caller selections to the telephone link and to send an audio message for the availability of selected portions of the first and second plurality of parking spaces in response to the caller selections.

11. A method for determining the availability of parking spaces including on-street parking spaces, comprising:

viewing a plurality of on-street parking spaces with a non-stereoscopic video camera to produce one or more images;

processing the one or more images to determine whether an associated on-street parking space is available;

updating a list to reflect the availability of the plurality of the on-street parking spaces in response to processing the one or more images; and broadcasting a signal indicating the availability of a portion of the plurality of parking spaces to interested persons via AM or FM transmission or to wireless telephone devices.

12. The method of claim 11, wherein the act of transmitting is performed in response to receiving a telephone call from a motorist.

13. The method of claim 12, further comprising:

receiving a telephone request from the motorist for the availability of a selected portion of the plurality of parking spaces; and wherein the act of transmitting indicates the availability of the selected portion.

14. A system for determining availability of on-street parking, comprising:

a plurality of non-stereoscopic video cameras mounted above an area containing on-street parking spaces, each camera adapted to scan an associated portion of the area and to produce video images during each scan;

a central processor;

a data connector to transmit the video images to the central processor;

wherein the central processor is adapted to analyze the video images received from the connector, to identify the parking spaces corresponding to the video images received, and to determine whether the identified parking spaces are occupied by employing at least one of an image analysis algorithm and an object analysis algorithm on the corresponding video images; and a device adapted to receive parking space availability data from the processor, the device adapted to broadcast information on available ones of the parking spaces to interested persons via AM or FM transmission or to wireless telephone devices.

15. The system of claim 14, further including a memory connected to the processor; and wherein the central processor is adapted to update a file in said memory, the file identifying parking availability by street.

16. A program storage device readable by a computer, tangibly embodying a program of instructions executable on the computer to perform a method for determining the availability of parking spaces on-street, the method comprising acts for comprising:

scanning a plurality of on-street parking spaces with a non-stereoscopic video camera to produce at least one image;

processing the image to determine whether an associated on-street parking space is available;

updating a list to reflect the availability of the associated on-street parking space in response to processing the image; and broadcasting a signal indicating the availability of a portion of the plurality of parking spaces to interested persons via AM or FM transmission or to wireless telephone devices.

17. The program storage device of claim 16, wherein the act of transmitting is performed in response to receiving a telephone call from a motorist.

18. The program storage device of claim 17, the method further comprising:

receiving a telephone request from the motorist for the availability of a selected portion of the plurality of parking spaces; and wherein the act of transmitting sends the availability of the selected portion.

19. The program storage devil of claim 17, the method further comprising:

receiving a telephone request from the motorist for the availability of parking spaces near a specified landmark; and wherein the act of transmitting sends the locations of available spaces on streets and/or in off-street parking facilities previously determined to be closest to said landmark.

* * * * *

UNITED STATES PATENT AND TRADEMARK OFFICE

CERTIFICATE OF CORRECTION

PATENT NO. : 6,285,297 B1
DATED : September 4, 2001
INVENTOR(S) : Jay H. Ball

It is certified that error appears in the above-identified patent and that said Letters Patent is hereby corrected as shown below:

Title page,
ABSTRACT,
Lines 1 and 2, "communication" should be -- communicating --
Line 3, after "optical" insert -- detector --
Line 10, "pace" should be -- space --

Column 3,
Line 42, "abovedescribed" should be -- above described --

Column 6,
Line 16, "vehicle" should be -- vehicles --

Column 8,
Line 56, "devil" should be -- device --

Signed and Sealed this

Nineteenth Day of March, 2002

*Attest:*

*Attesting Officer*

JAMES E. ROGAN
*Director of the United States Patent and Trademark Office*